US009630741B2

(12) United States Patent
McClaughry

(10) Patent No.: US 9,630,741 B2
(45) Date of Patent: Apr. 25, 2017

(54) RECLOSEABLE PAPERBOARD CARTON WITH THERMOFORMED CLOSURE

(71) Applicant: SONOCO DEVELOPMENT, INC., Hartsville, SC (US)

(72) Inventor: Thomas Ryan McClaughry, Batavia, IL (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 14/868,667

(22) Filed: Sep. 29, 2015

(65) Prior Publication Data

US 2016/0090206 A1 Mar. 31, 2016

Related U.S. Application Data

(60) Provisional application No. 62/056,660, filed on Sep. 29, 2014.

(51) Int. Cl.
*B65D 5/66* (2006.01)
*B65D 43/16* (2006.01)
*B65D 51/20* (2006.01)

(52) U.S. Cl.
CPC ..... *B65D 5/6697* (2013.01); *B65D 43/169* (2013.01); *B65D 51/20* (2013.01)

(58) Field of Classification Search
CPC ..... B65D 75/08; B65D 31/10; B65D 5/6697; B65D 43/169; B65D 2543/00648; B31B 2219/23
USPC ..... 383/121, 123, 104, 120; 493/218; 229/125.02, 125.08, 125.14, 125.09, 229/125.13, 125.17, 125.25, 125.26; 220/254.3, 810, 840; 206/470
See application file for complete search history.

(56) References Cited

U.S. PATENT DOCUMENTS

| | | | | |
|---|---|---|---|---|
| 4,428,497 | A * | 1/1984 | Julius | A47K 10/421 206/210 |
| 5,050,763 | A * | 9/1991 | Christensson | B65D 5/64 220/810 |
| 5,341,952 | A * | 8/1994 | Goglio | B65D 77/06 220/495.08 |
| 6,394,339 | B1 | 5/2002 | Giblin | |
| 6,536,627 | B1 | 3/2003 | Benoit-Gonin et al. | |
| 7,886,927 | B2 | 2/2011 | Frey et al. | |
| 7,934,616 | B2 | 5/2011 | Felber | |
| 8,011,566 | B2 * | 9/2011 | Robertson | B65D 43/165 220/833 |
| 2008/0099546 | A1 | 5/2008 | Cronin et al. | |

* cited by examiner

*Primary Examiner* — Christopher Demeree
(74) *Attorney, Agent, or Firm* — Miller, Matthias & Hull LLP

(57) ABSTRACT

A recloseable container comprising a substantially rectilinear, paperboard-based carton and a plastic recloseable device is provided. The carton defines a container interior and has a face panel defining an opening. The opening has a perimeter sized to receive the recloseable device. The recloseable device may be a plastic unitary structure similar to a clamshell type blister pack and may comprise a frame attached to the carton and a door hingedly attached to the frame.

12 Claims, 5 Drawing Sheets

RECLOSEABLE PAPERBOARD CARTON WITH THERMOFORMED CLOSURE

BACKGROUND OF THE INVENTION

Field of the Invention

This invention patent relates to recloseable containers. More particularly, this invention relates to a recloseable paperboard carton with a plastic thermoformed closure.

Description of the Related Art

Current recloseable features for paperboard cartons are limited to flaps, slots and other mechanical means of closure that rely on the structural and folding properties of the paperboard itself to remain marginally effective. Repetitive opening and closing quickly degrades the marginal seal these features provide. Paperboard flaps, even if they tear properly and are not destroyed at the outset, offer limited closeability and a poor seal. The present disclosure addresses these problems by providing a more durable recloseable closure for a paperboard carton.

BRIEF SUMMARY OF THE INVENTION

The present disclosure provides a recloseable container comprising a paperboard-based carton and a plastic recloseable device. The carton defines a container interior and has a face panel defining an opening. The opening has a perimeter sized to receive the plastic recloseable device.

The recloseable device may be a plastic unitary structure and may comprise a frame that attaches to the carton and a door hingedly attached to the frame. The frame may be sized to fit snugly within the carton opening and may comprise a planar securing flange extending around the perimeter of the carton opening and having an underside abutting the face panel, an annular side wall extending from the securing flange into the container interior, and a planar bottom wall extending inwardly from the annular side wall and defining a frame opening.

The door may comprise a planar peripheral portion attached to the securing flange by one or more integrally formed hinges, an annular side wall extending from the peripheral portion, and a cover extending from the annular side wall and configured to cover the frame opening.

In a second embodiment an insert card may be interposed between the door and the frame and, more particularly, between the door cover and the frame bottom wall. The insert card may define a hole through which the contents can be viewed before the container is opened.

In a third embodiment the bottom wall of the frame comprises a removable center panel having a perforated perimeter.

DETAILED DESCRIPTION OF THE INVENTION

Figure 1:
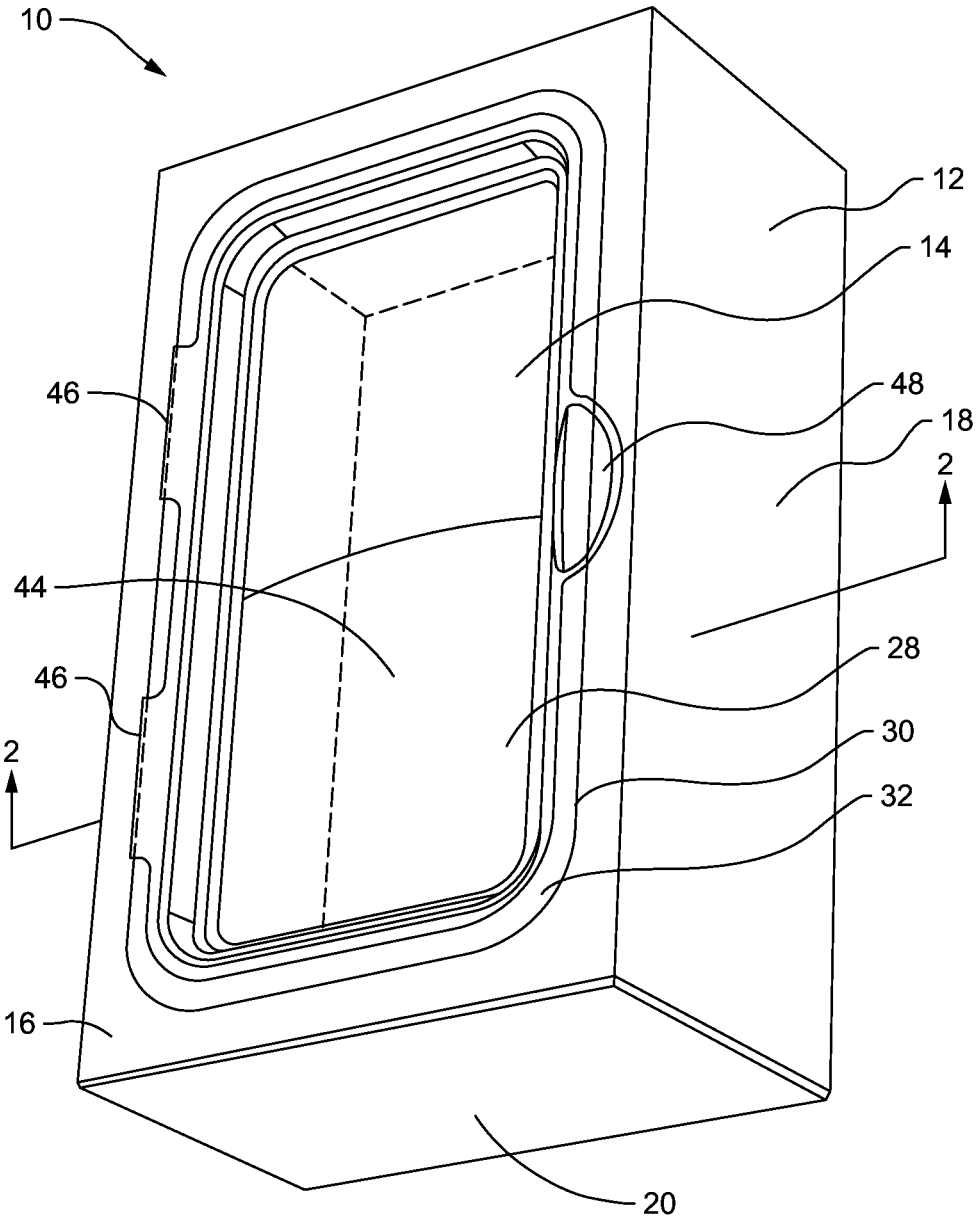
FIG. 1 is a perspective view of a first embodiment of a recloseable container according to the disclosure.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

Turning to the drawings, there is shown in FIGS. 1 and 2 one embodiment of the present invention, a container 10 comprising a carton 12 and a recloseable device 14.

The carton 12 may be made of a paperboard based material or any suitable material that can be cut, scored, folded, glued, erected, filled with product, and sealed securely around the edges in any conventional manner. The carton 12 may rectilinear in shape, wedge shaped, pillow box shaped or any suitable shape. In the illustrated embodiment the carton 12 comprises a face panel 16, two opposing side panels 18, two opposing end panels 20, and a rear panel 22 opposite the face panel 16. The face panel 16 defines a carton opening 24 that may be die-cut into the face panel 16. The opening 24 has a perimeter 26 and is sized to receive the recloseable device 14. A seal coating or seal beads 27 may be applied to the face panel 16 near the perimeter 26 for adhering the recloseable device 14 to the carton 12. The recloseable device 14 may be a unitary (single piece) thermoformed blister structure comprising a door 28 and a frame 30.

Figure 2A:
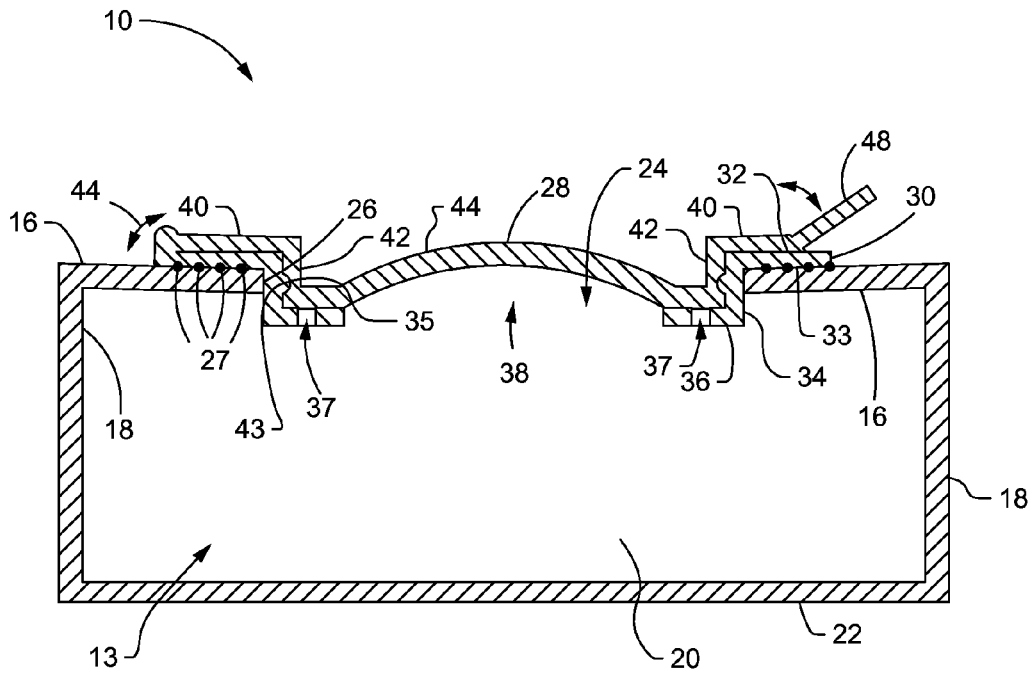
FIG. 2*a* is a cross-sectional view of the container of FIG. 1 taken along line 2-2.
Figure 2B:
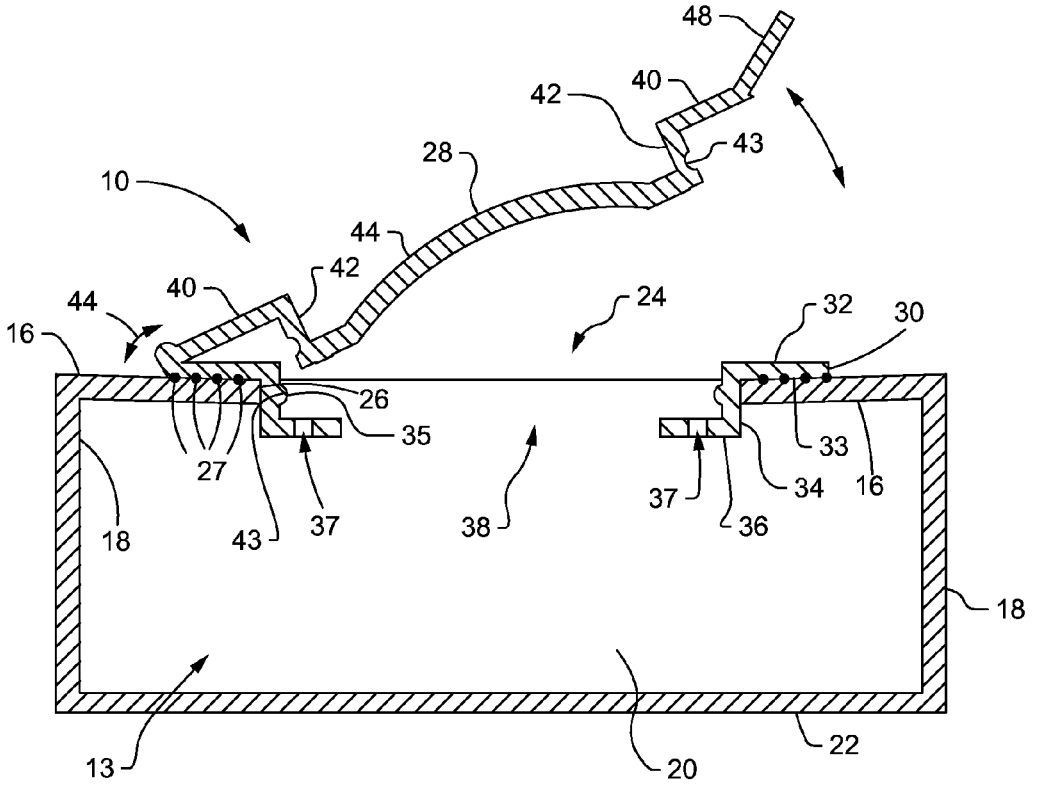
FIG. 2*b* is a cross-sectional view of the container in an open configuration.

The door 28 is moveable between a closed position in which the door 28 forms a snap fit with the frame 30 to seal the container 10 (FIG. 2*a*), and an open position in which the door 28 is lifted away from the frame 30 to expose the interior 13 of the container 10 and make the contents accessible to a user (FIG. 2*b*). The door 28 may include a grip or pull tab 48 extending from a peripheral portion 40 for the user to grip while opening the container 10.

As best shown in FIGS. 2*a* and 2*b*, the frame 30 portion of the recloseable device 14 is sized to fit snugly within the opening 24 and comprises a planar securing flange 32, an annular side wall 34 extending perpendicularly from the securing flange 32 into the carton opening 24, and a planar bottom wall 36 extending inwardly from the bottom edge of the annular side wall 34 and defining a dispensing opening 38. Optionally, the bottom wall 36 may define perforations 37 to facilitate opening.

The securing flange 32 extends around the perimeter 26 of the carton opening 24 and has an underside 33 that abuts the face panel 16. The securing flange 32, and thus the recloseable device 14, can be adhered to the face panel 16 with any adhesive or can be secured with a spot-applied heat seal coating or seal beads 27.

Alternatively, the topside of the securing flange 32 may abut and be sealed to the interior facing underside of the face panel 16 so the consumer does not see the flange 32. Also, the annular side wall 34 may extend outward (away from the container interior 13) rather than inward.

The door portion 28 of the recloseable device 14 comprises a planar peripheral portion 40, an annular side wall 42 extending perpendicularly from the peripheral portion 40, and a cover 44 extending peripherally inward from the annular side wall 42. The cover 44 may be any suitable shape, including flat and dome shaped as shown in the figures to enhance rigidity. The peripheral portion 40 of the door 28 may be attached to the securing flange 32 portion of the frame 30 by one or more integrally formed or coined hinges 46.

When the door 28 is closed as shown in FIG. 2*a*, the door's annular side wall 42 extends below the plane of the face panel 16 and mates with the annular side wall 34 of the frame 30. For example, the annular side wall 34 of the frame 30 may have peripherally inwardly extending beads, ridges 35 or other fastening means for forming a snap fit with undercuts 43 or other complementary fastening means on the annular side wall 42 of the door 28. Alternatively, the annular side wall 34 of the frame 30 may define undercuts and the annular side wall 42 of the door 28 may include beads, ridges 35 or other fastening means.

Figure 3:
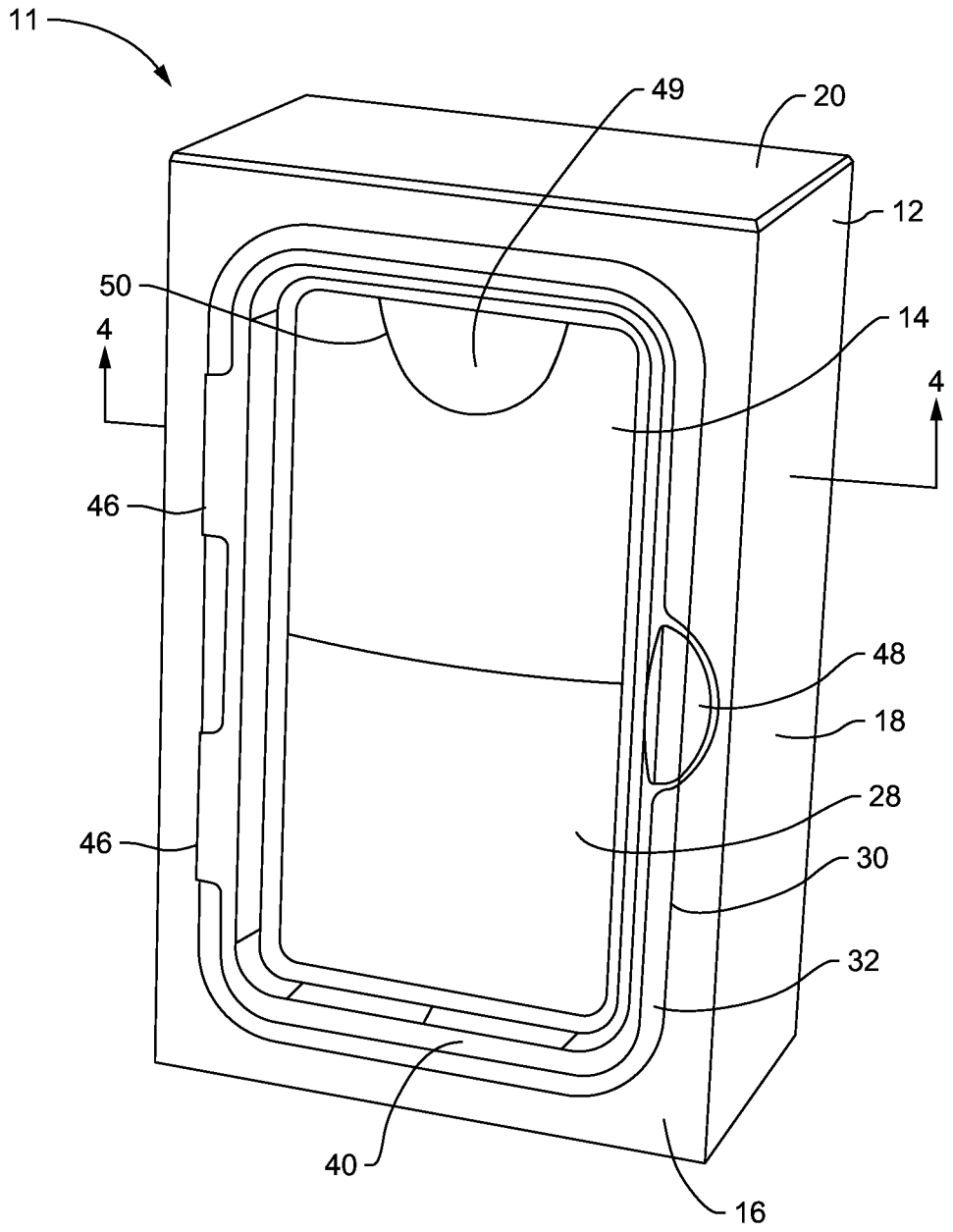
FIG. 3 is a perspective view of a second embodiment of a container according to the disclosure.
Figure 4:
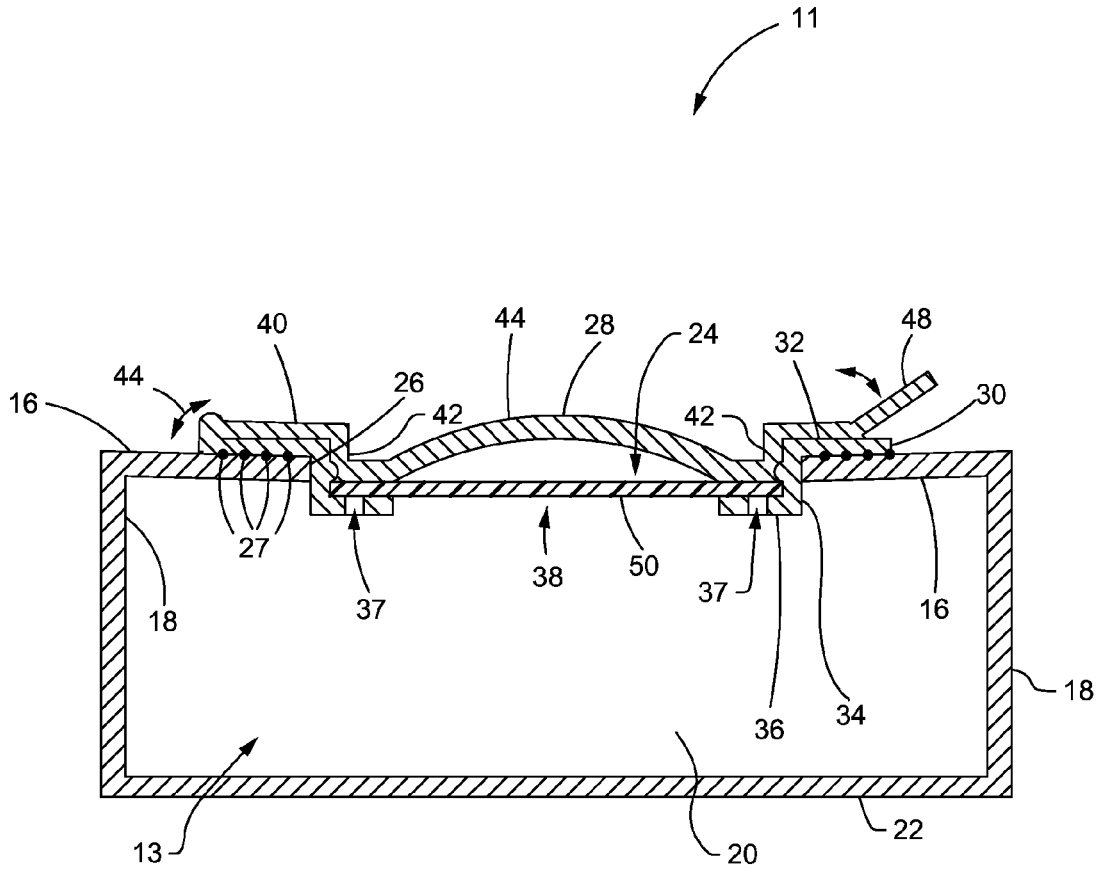
FIG. 4 is a cross-sectional view of the container of FIG. 3 taken along line 4-4.

FIGS. 3 and 4 show a second embodiment of a container 11 according to the disclosure. As best shown in FIG. 4, an insert card 50 is located between the door 28 and the frame 30 to further cover the dispensing opening 38. Preferably there is a clearance (gap) between the door cover 44 and the bottom wall 36 of the frame 30 to accommodate the insert card 50. The insert card 50 may be printed with graphics or other information about the contents of the container 10. The insert card 50 may define a hole or perimeter notch 49 which allows the user to easily lift out the card 50 and access the contents. Preferably the card 50 is not secured to the frame 30, but rather "floats" in the space between the frame 30 and the door 28 when the container 11 is closed. The perforations 37 in the bottom wall 36 shown in FIG. 4 are optional.

Figure 5:
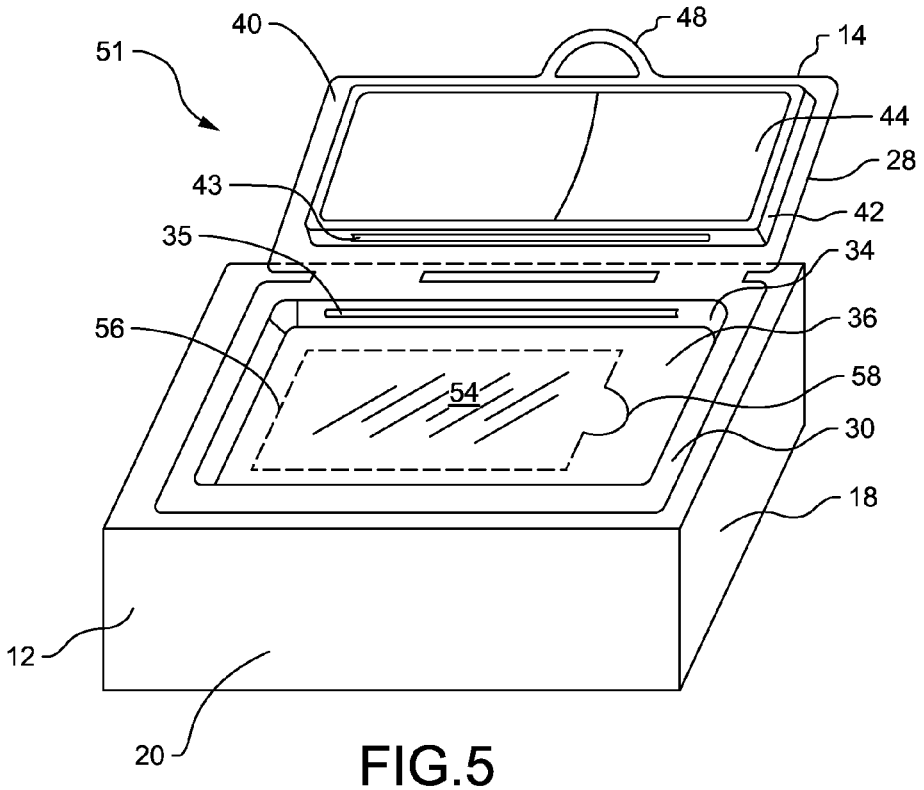
FIG. 5 is a perspective view of a third embodiment of a container according to the disclosure.
Figure 6:
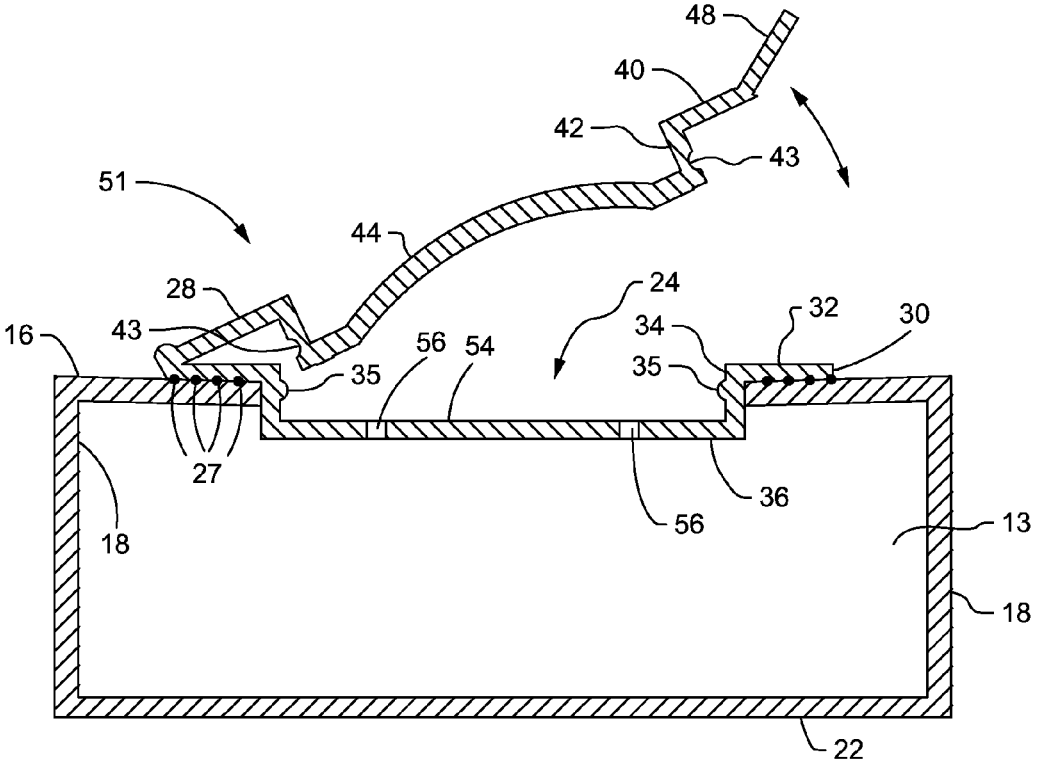
FIG. 6 is a cross sectional view of the embodiment of FIG. 5.

FIGS. 5 and 6 show a third embodiment of a container 51 according to the disclosure. As in the two previous embodiments, the container 51 comprises a paperboard carton 12 and a plastic recloseable device 14. As in the second embodiment, an insert card may be located between the door 28 and the frame 30 to further cover the dispensing opening 38, although no insert card is shown in FIGS. 5 and 6.

In a key aspect of this embodiment the bottom wall 36 covers the container interior 13 and comprises a removable center panel 54. The removable center panel 54 may have a perforated perimeter 56 and a die cut pull tab 58 or other lifting means for removing the center panel 54. After opening the door 28, the user may lift up on the pull tab 58 to remove the center panel 54, allowing access to the container contents.

The container 10, 11, 51 may be used in the following manner. First, the user pulls on the pull tab 48 to lift the door 28 away from the frame 30. Second, the user may remove the optional insert card 50 or the center panel 54 of the recloseable device 14, if the recloseable device 14 covers the dispensing opening 38. The container 10 can be reclosed by closing the door 28 so that the ridges 35 engage the undercuts 43 to form a snap fit. Multiple open and reclose operations can be made without compromising the integrity of the seal between the door 28 and the frame 30.

INDUSTRIAL APPLICABILITY

The container described and claimed herein can be used in the pet food industry, home goods industry, hardware industry, personal care industry, automobile industry or for any application calling for a non-hermetically sealed recloseable paperboard-based container for holding consumables.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A container comprising:

a carton comprising two opposing side panels, two opposing end panels, a planar face panel extending inwardly from the side panels and the end panels, and a rear panel opposite the face panel, the carton defining an interior, the face panel defining a carton opening, the carton opening having a perimeter sized to receive a recloseable device; and a unitary, plastic, hinged recloseable device, the recloseable device comprising:

a frame sized to fit snugly within the opening and comprising a planar securing flange extending around the perimeter of the carton opening and having an underside abutting the face panel, a frame annular side wall extending perpendicularly from the securing flange into the carton opening, and a planar bottom wall extending peripherally inwardly from the annular side wall and defining a dispensing opening; and a door comprising a planar peripheral portion attached to the securing flange by one or more integrally formed hinges, a door annular side wall extending perpendicularly from the peripheral portion, and a cover extending from the peripheral portion and configured to cover the dispensing opening.

2. The container of claim 1 wherein the carton is made of paperboard.

3. The container of claim 1 wherein the door annular side wall includes first fastening means that form a snap fit with complementary fastening means on the frame.

4. The container of claim 3 wherein the first fastening means comprises undercuts defined by the door annular side wall.

5. The container of claim 1 wherein the door is hingedly moveable between a first position in which the cover covers the dispensing opening and a second position in which the cover does not cover the dispensing opening.

6. The container of claim 5 wherein in the first position the door is substantially parallel to the frame and forms a snap fit with the frame.

7. The container of claim 5 wherein in the second position the door forms an angle with the frame.

8. The container of claim 5 wherein the door comprises a pull tab extending from the peripheral portion of the door and configured to be gripped by a user opening the container.

9. A container comprising:

a carton defining an interior and comprising two opposing side panels and two opposing end panels having top edges defining a carton perimeter, a planar top panel extending inwardly from the two opposing side panels and the two opposing end panels and defining a carton opening, the carton opening being smaller than the carton perimeter and sized to receive a recloseable device, and a bottom panel opposite the top panel; and a unitary, plastic, hinged recloseable device attached to the carton top panel, the recloseable device comprising:

a frame sized to fit snugly within the carton opening and comprising a planar securing flange extending around the perimeter of the carton opening and having an underside abutting the top panel and a frame annular side wall extending from the securing flange into the carton opening; and a door comprising a planar peripheral portion attached to the securing flange by one or more integrally formed hinges, a door annular side wall extending downward from the peripheral portion, and a cover portion extending from the peripheral portion and configured to completely enclose the carton interior.

10. The container of claim 9 wherein the frame further comprises:

a planar bottom wall extending inwardly from the frame annular side wall and defining a dispensing opening.

11. The container of claim 10 wherein:

the door is hingedly moveable between a first position in which the cover portion covers the dispensing opening and a second position in which the cover portion does not cover the dispensing opening.

12. The container of claim 10 wherein:

when the door is in the second position, at least a portion of the door cover portion mates with the planar bottom wall of the frame in flat abutting relationship therewith.

* * * * *